US006929387B2

(12) United States Patent
Hsu

(10) Patent No.: US 6,929,387 B2
(45) Date of Patent: Aug. 16, 2005

(54) SUSPENSION LAMP HAVING QUICK CONNECTION FUNCTION

(75) Inventor: Kevin Hsu, Taichung (TW)

(73) Assignee: Dong Guan Bright Yinhuey Lighting Co., Ltd. China, Guang Dong (CN)

( * ) Notice: Subject to any disclaimer, the term of this patent is extended or adjusted under 35 U.S.C. 154(b) by 69 days.

(21) Appl. No.: 10/694,131

(22) Filed: Oct. 27, 2003

(65) Prior Publication Data

US 2005/0088841 A1 Apr. 28, 2005

(51) Int. Cl.[7] ..... F21S 8/06

(52) U.S. Cl. ..... 362/405; 362/147; 362/226; 362/404; 362/406; 362/236; 362/249; 439/409; 439/537

(58) Field of Search ..... 362/405, 147, 362/226, 404, 406, 236, 249; 439/409, 537

(56) References Cited

U.S. PATENT DOCUMENTS 4,079,244 A * 3/1978 Bortoluzzi ..... 362/405
4,721,480 A * 1/1988 Yung ..... 439/527
5,385,482 A * 1/1995 Rottner ..... 439/409
6,565,240 B1 * 5/2003 Wu ..... 362/405
6,793,383 B2 * 9/2004 Wu ..... 362/405
6,840,651 B2 * 1/2005 Wu ..... 362/226

* cited by examiner

*Primary Examiner*—Stephen Husar
*Assistant Examiner*—James W Cranson
(74) *Attorney, Agent, or Firm*—Alan D. Kamrath; Nikolai & Mersereau, P.A.

(57) ABSTRACT

A suspension lamp includes a switch box, a wire connection base, a circuit board, a power supply wire, a plurality of protective jackets, a plurality of connecting terminals, and a plurality of electric wires. Thus, the operator only needs to insert each of the connecting terminals into a respective one of the protective jackets so as to form an electrical connection state, so that the electric circuit of the suspension lamp is connected easily and conveniently, thereby facilitating the operator mounting the electric circuit of the suspension lamp.

11 Claims, 5 Drawing Sheets

SUSPENSION LAMP HAVING QUICK CONNECTION FUNCTION

BACKGROUND OF THE INVENTION

1. Field of the Invention

The present invention relates to a suspension lamp, and more particularly to a suspension lamp having a quick connection function.

2. Description of the Related Art

A conventional suspension lamp 1 in accordance with the prior art shown in FIG. 1 comprises a switch box 11 having a peripheral wall formed with a plurality of locking grooves 111, a plurality of bent support tubes 12 each mounted on the switch box 11 and each having an end formed with a connector 121 locked in a respective one of the locking grooves 111 of the switch box 11, an upper cover 14 mounted on an opened top of the switch box 11 and having a center formed with a through hole 141, a hollow threaded rod 13 mounted in the switch box 11 and having a first end extended through the through hole 141 of the upper cover 14 and a second end formed with a threaded section 131 formed with an opening 132, a nut 142 screwed on the first end of the threaded rod 13 and rested on the upper cover 14, a screw 15 extended through a closed bottom of the switch box 11 and screwed into the threaded section 131 of the threaded rod 13, and a nut 16 screwed on the screw 15 and rested on the bottom of the switch box 11. The conventional suspension lamp further comprises a power supply wire 17 extended through the threaded rod 13 and the opening 132, and a plurality of electric wires 18 each extended through a respective one of the support tubes 12 and each connected to the power supply wire 17.

However, the operator needs to separate the positive and negative poles of each of the electric wires 18 respectively, so that the positive and negative poles of each of the electric wires 18 are connected to the positive and negative poles of the power supply wire 17 respectively and are coated by a protective tape 19 to prevent occurrence of electrical leakage. Thus, the operator is located a higher position to separate the positive and negative poles of each of the electric wires 18 respectively so as to connect the positive and negative poles of each of the electric wires 18 with the positive and negative poles of the power supply wire 17 respectively and to coat the connected electric wires 18 by the protective tapes 19, thereby causing inconvenience to the operator in assembly of the conventional suspension lamp.

SUMMARY OF THE INVENTION

The primary objective of the present invention is to provide a suspension lamp having a quick connection function.

Another objective of the present invention is to provide a suspension lamp having a better safety when in use.

A further objective of the present invention is to provide a suspension lamp, wherein the operator only needs to insert each of the connecting terminals into a respective one of the protective jackets so as to form an electrical connection state, so that the electric circuit of the suspension lamp is connected easily and conveniently, thereby facilitating the operator mounting the electric circuit of the suspension lamp.

In accordance with the present invention, there is provided a suspension lamp, comprising a switch box, a wire connection base, a circuit board, a power supply wire, a plurality of protective jackets, a plurality of connecting terminals, and a plurality of electric wires, wherein:

the wire connection base is mounted in the switch box and includes a main body;

the circuit board is mounted in the main body of the wire connection base and has a side provided with a plurality of first plugs and a plurality of second plugs;

the power supply wire is connected to the circuit board and having a positive pole connected to each of the first plugs of the circuit board and a negative pole connected to each of the second plugs of the circuit board;

each of the protective jackets is mounted on the circuit board for mounting a respective one of the first plugs of the circuit board and a respective one of the second plugs of the circuit board;

each of the connecting terminals is inserted into a respective one of the protective jackets; and each of the electric wires is mounted on a respective one of the connecting terminals and has a positive pole formed with a first plug connected to a respective one of the first plugs of the circuit board and a negative pole formed with a second plug connected to a respective one of the second plugs of the circuit board.

Further benefits and advantages of the present invention will become apparent after a careful reading of the detailed description with appropriate reference to the accompanying drawings.

DETAILED DESCRIPTION OF THE INVENTION

Figure 1:
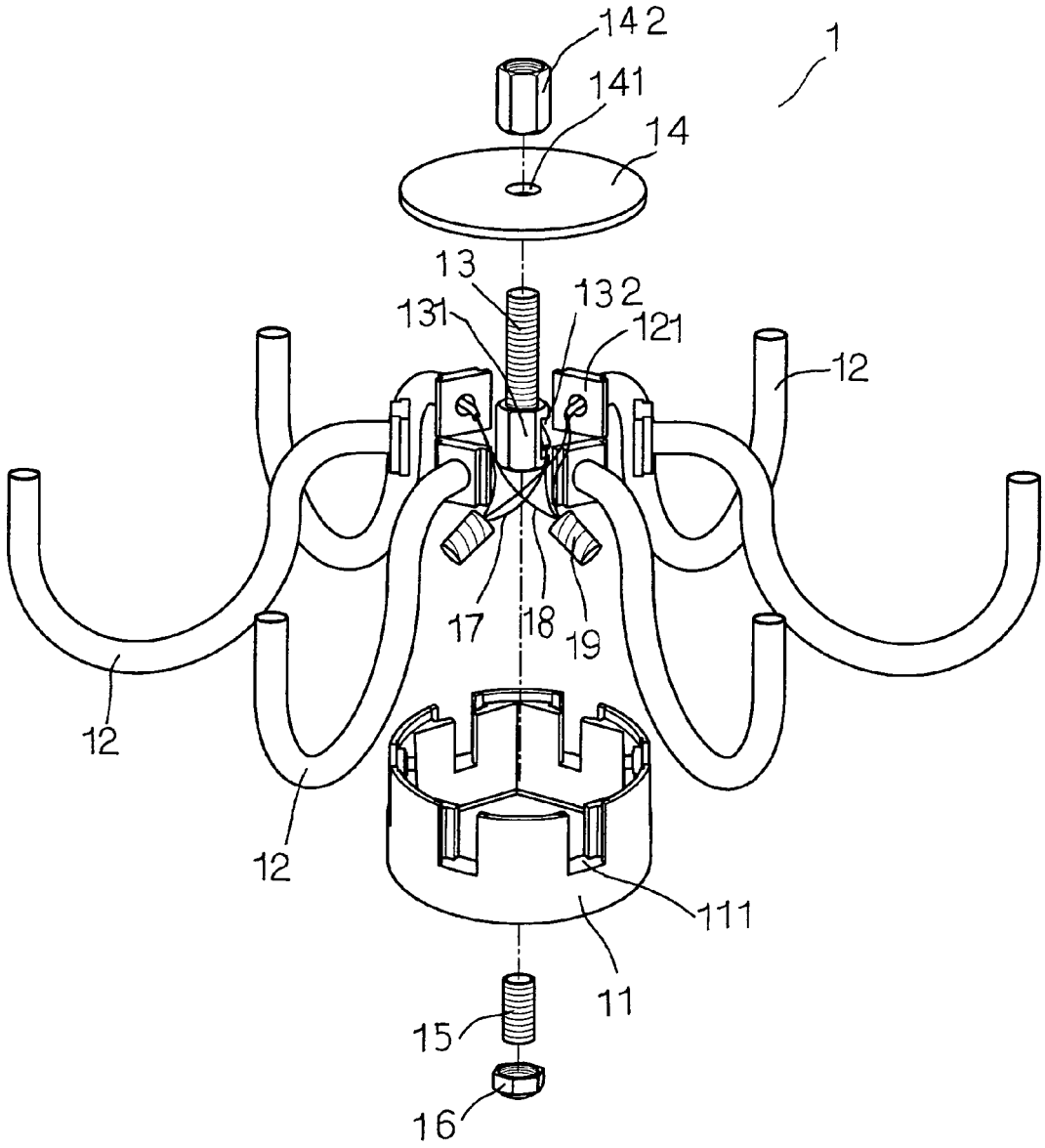
FIG.1 PRIOR ART
FIG. 1 is an exploded perspective view of a conventional suspension lamp in accordance with the prior art.

Referring to the drawings and initially to FIGS. 2–5, a suspension lamp in accordance with the preferred embodiment of the present invention comprises a switch box 2 having a peripheral wall formed with a plurality of locking grooves 21, a plurality of bent support tubes 3 each mounted on the switch box 2 and each having an end formed with a connector 31 locked in a respective one of the locking grooves 21 of the switch box 2, an upper cover 23 mounted on an opened top of the switch box 2 and having a center formed with a through hole 231, a hollow threaded rod 22 mounted in the switch box 2 and having a first end extended through the through hole 231 of the upper cover 23 and a second end formed with a threaded section 221 formed with an opening 222, a nut 232 screwed on the first end of the threaded rod 22 and rested on the upper cover 23, a screw 24 extended through a closed bottom of the switch box 2 and screwed into the threaded section 221 of the threaded rod 22, and a nut 25 screwed on the screw 24 and rested on the bottom of the switch box 2.

The suspension lamp further comprises a wire connection base 4, a circuit board 5, a plurality of protective jackets 52, and a plurality of connecting terminals 6.

The wire connection base 4 is mounted in the switch box 2 and includes a main body 41 having a center formed with a passage hole 411 for passage of the screw 24. The main body 41 of the wire connection base 4 has an inner wall having a first side formed with a plurality of receiving seats 412 and a second side formed with a plurality of locking flanges 413. Preferably, the receiving seats 412 and the locking flanges 413 of the main body 41 of the wire connection base 4 are arranged in an opposite staggered manner.

The circuit board 5 is mounted in the main body 41 of the wire connection base 4 and is clamped between the receiving seats 412 and the locking flanges 413 of the main body 41 of the wire connection base 4. The circuit board 5 has a center formed with a passage hole 50 for passage of the screw 24. The circuit board 5 has a side provided with a plurality of first plugs 51 each formed with a plurality of locking blocks 511 and a plurality of second plugs 53 each formed with a plurality of locking blocks 531. Preferably, each of the first plugs 51 of the circuit board 5 is juxtaposed to a respective one of the second plugs 53 of the circuit board 5.

Figure 4:
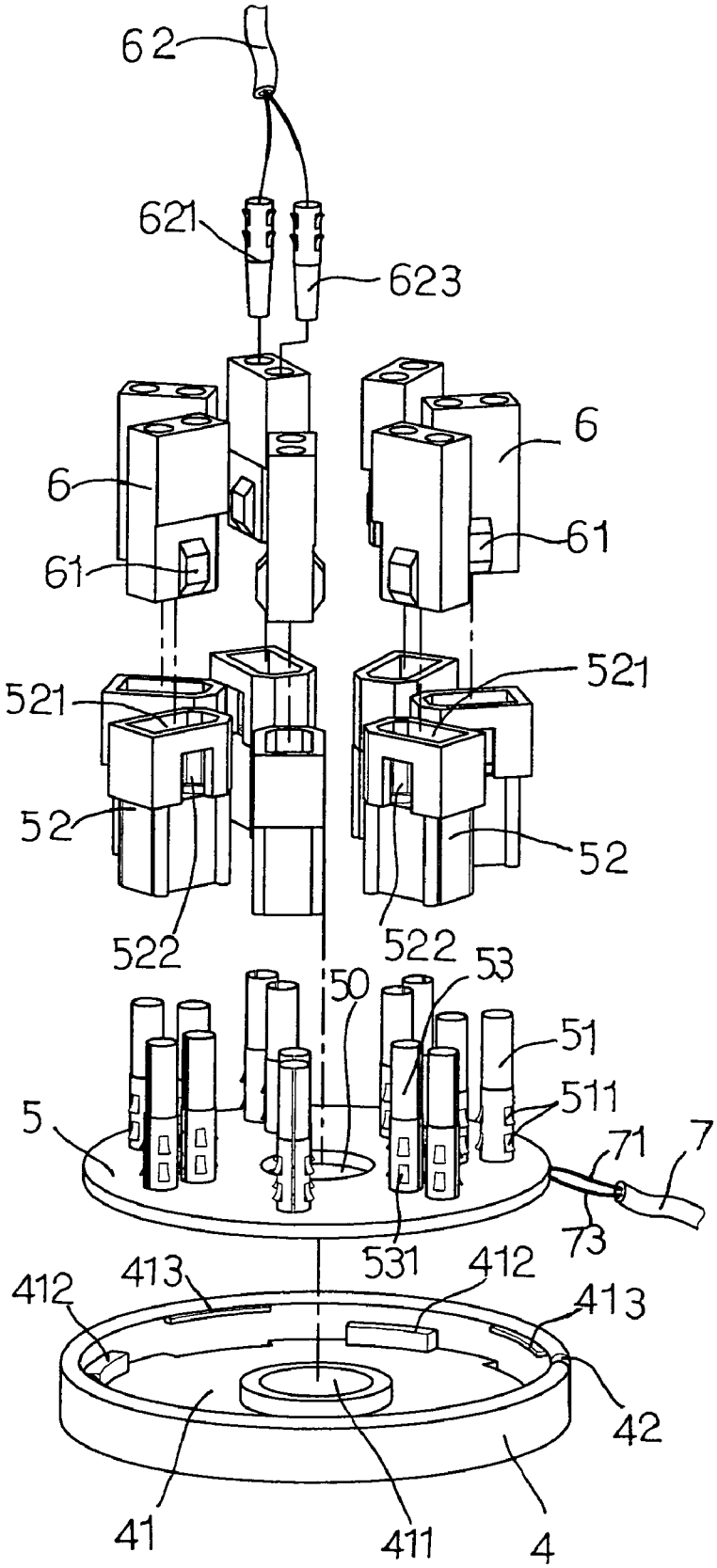
FIG. 4 is a partially exploded perspective view of the suspension lamp as shown in FIG. 2.
Figure 5:
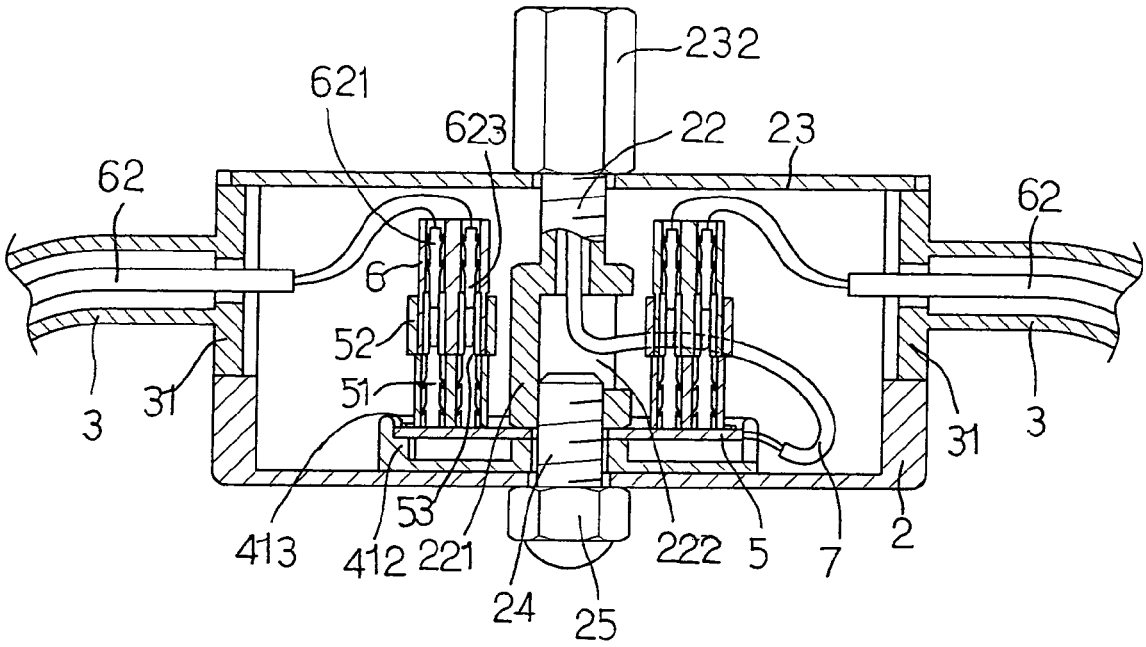
FIG. 5 is a partially cut-away plan cross-sectional view of the suspension lamp as shown in FIG. 2.
Figure 6:
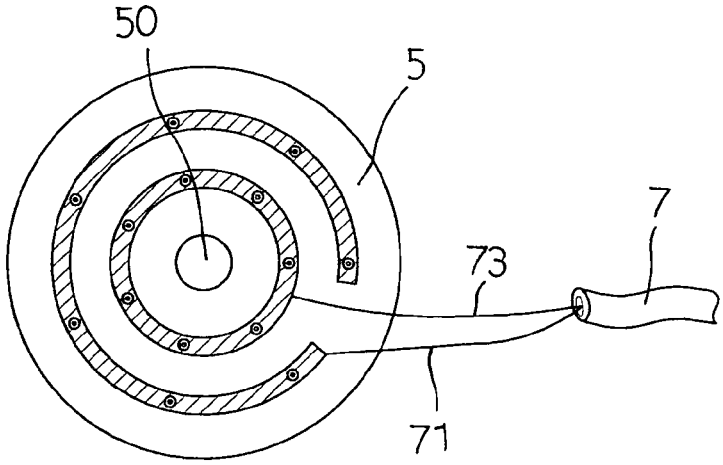
FIG. 6 is a partially plan cross-sectional view of the suspension lamp as shown in FIG. 2.

As shown in FIGS. 4 and 6, the suspension lamp further comprises a power supply wire 7 connected to the circuit board 5 and having a positive pole 71 connected to a positive pole of the circuit board 5 and connected to each of the first plugs 51 of the circuit board 5 and a negative pole 73 connected to a negative pole of the circuit board 5 and connected to each of the second plugs 53 of the circuit board 5. In addition, the main body 41 of the wire connection base 4 has a periphery formed with a cutout 42 for passage of the power supply wire 7.

Each of the protective jackets 52 is mounted on the circuit board 5 for mounting a respective one of the first plugs 51 of the circuit board 5 and a respective one of the second plugs 53 of the circuit board 5. Preferably, each of the protective jackets 52 is secured on the circuit board 5 by the locking blocks 511 and 531 of the respective first and second plugs 51 and 53 of the circuit board 5. Each of the protective jackets 52 has an upper end formed with an opening 521 and a periphery formed with a locking slot 522 communicating with the opening 521.

Each of the connecting terminals 6 is inserted into a respective one of the protective jackets 52. Preferably, each of the connecting terminals 6 is inserted into the opening 521 of a respective one of the protective jackets 52 and has a lower end formed with a locking block 61 locked in the locking slot 522.

The suspension lamp further comprises a plurality of electric wires 62 each mounted on a respective one of the connecting terminals 6 and each having a positive pole formed with a first plug 621 inserted into a positive pole of the respective connecting terminal 6 and connected to a respective one of the first plugs 51 of the circuit board 5 and a negative pole formed with a second plug 623 inserted into a negative pole of the respective connecting terminal 6 and connected to a respective one of the second plugs 53 of the circuit board 5.

In assembly, the power supply wire 7 is extended through the threaded rod 22 and the opening 222, and is extended into the switch box 2. Then, the power supply wire 7 is connected to the circuit board 5, with its positive pole 71 connected to the positive pole of the circuit board 5 and connected to each of the first plugs 51 of the circuit board 5 and with its negative pole 73 connected to the negative pole of the circuit board 5 and connected to each of the second plugs 53 of the circuit board 5 to form an electrical connection state.

Then, each of the protective jackets 52 is mounted on the circuit board 5 for mounting a respective one of the first plugs 51 of the circuit board 5 and a respective one of the second plugs 53 of the circuit board 5. Then, the circuit board 5 is mounted in the main body 41 of the wire connection base 4 and is clamped between the receiving seats 412 and the locking flanges 413 of the main body 41 of the wire connection base 4. At this time, the main body 41 of the wire connection base 4 has a periphery formed with a cutout 42 for passage of the power supply wire 7.

Then, the wire connection base 4 is mounted in the switch box 2. Then, the connector 31 of each of the support tubes 3 is locked in a respective one of the locking grooves 21 of the switch box 2. Then, each of the electric wires 62 is extended through a respective one of the support tubes 3. At this time, each of the electric wires 62 is mounted on a respective one of the connecting terminals 6 and has a positive pole formed with a first plug 621 inserted into a positive pole of the respective connecting terminal 6 and a negative pole formed with a second plug 623 inserted into a negative pole of the respective connecting terminal 6.

Then, each of the connecting terminals 6 is inserted into the opening 521 of a respective one of the protective jackets 52, so that the first plug 621 of each of the electric wires 62 is electrically connected to a respective one of the first plugs 51 of the circuit board 5 and the second plug 623 of each of the electric wires 62 is electrically connected to a respective one of the second plugs 53 of the circuit board 5 to form an electrical connection state.

Figure 2:
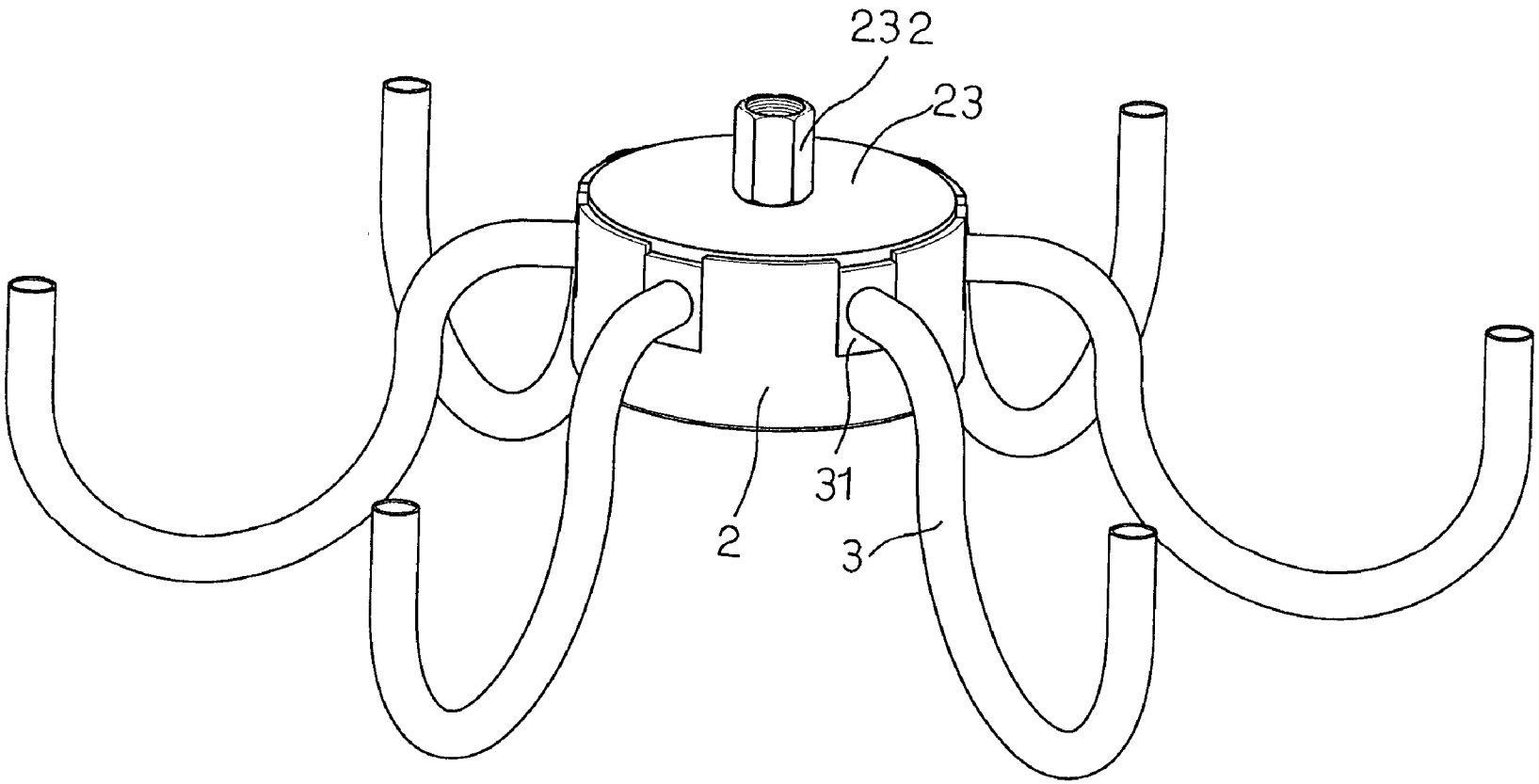
FIG. 2 is a perspective view of a suspension lamp in accordance with the preferred embodiment of the present invention.
Figure 3:
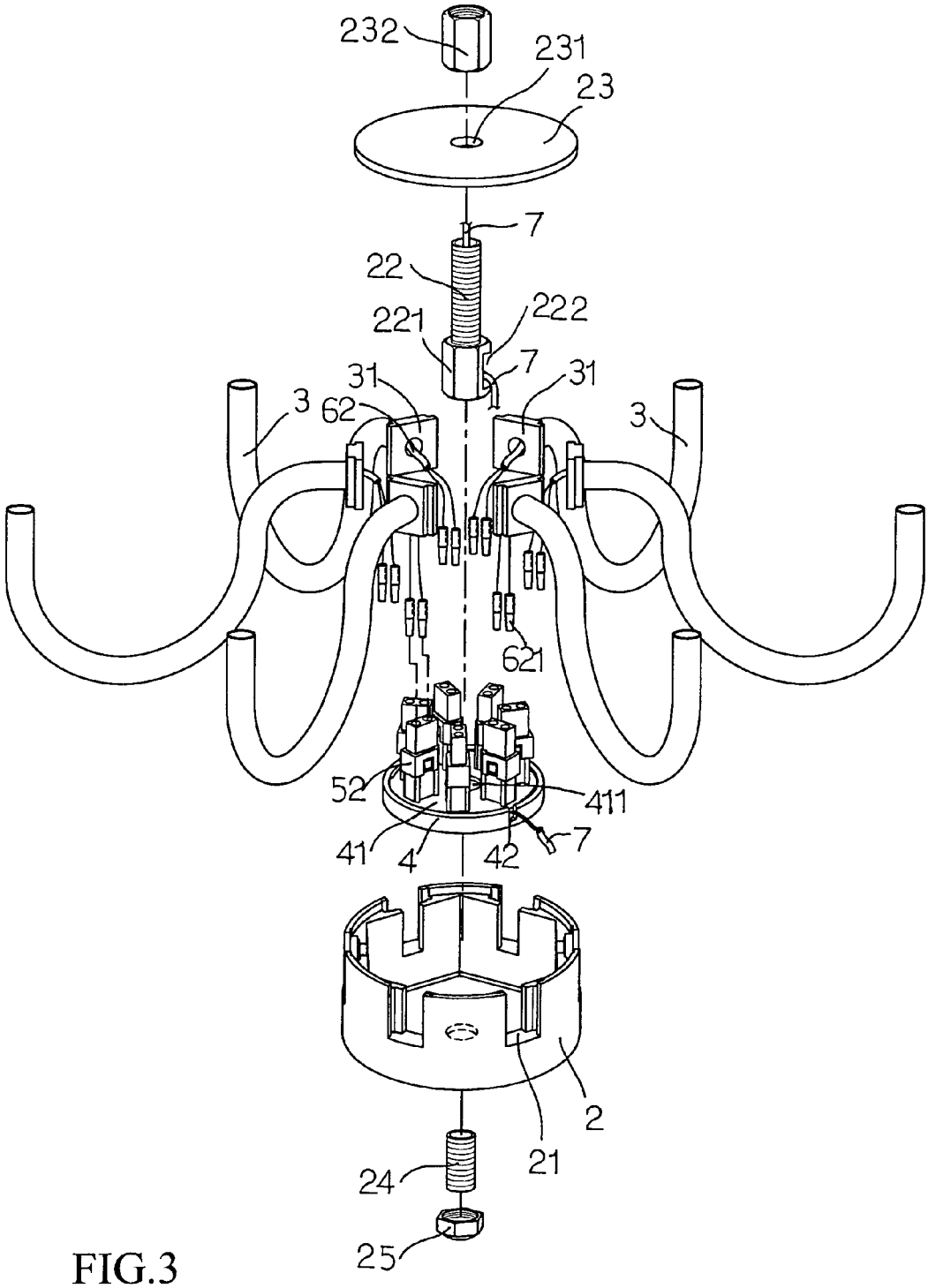
FIG. 3 is an exploded perspective view of the suspension lamp as shown in FIG. 2.

Finally, the upper cover 23 is mounted on the opened top of the switch box 2 and is combined with the threaded rod 22 by the nut 232, and the threaded rod 22 is combined with the screw 24 by the nut 25, thereby assembling the suspension lamp as shown in FIG. 2.

Accordingly, the operator only needs to insert each of the connecting terminals 6 into a respective one of the protective jackets 52 so as to form an electrical connection state, so that the electric circuit of the suspension lamp is connected easily and conveniently, thereby facilitating the operator mounting the electric circuit of the suspension lamp.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A suspension lamp, comprising a switch box, a wire connection base, a circuit board, a power supply wire, a plurality of protective jackets, a plurality of connecting terminals, and a plurality of electric wires, wherein:

the wire connection base is mounted in the switch box and includes a main body;

the circuit board is mounted in the main body of the wire connection base and has a side provided with a plurality of first plugs and a plurality of second plugs;

the power supply wire is connected to the circuit board and having a positive pole connected to each of the first plugs of the circuit board and a negative pole connected to each of the second plugs of the circuit board;

each of the protective jackets is mounted on the circuit board for mounting a respective one of the first plugs of the circuit board and a respective one of the second plugs of the circuit board;

each of the connecting terminals is inserted into a respective one of the protective jackets; and each of the electric wires is mounted on a respective one of the connecting terminals and has a positive pole formed with a first plug connected to a respective one of the first plugs of the circuit board and a negative pole formed with a second plug connected to a respective one of the second plugs of the circuit board.

2. The suspension lamp in accordance with claim 1, wherein the main body of the wire connection base has an inner wall having a first side formed with a plurality of receiving seats and a second side formed with a plurality of locking flanges, and the circuit board is clamped between the receiving seats and the locking flanges of the main body of the wire connection base.

3. The suspension lamp in accordance with claim 2, wherein the receiving seats and the locking flanges of the main body of the wire connection base are arranged in an opposite staggered manner.

4. The suspension lamp in accordance with claim 1, wherein each of the first plugs of the circuit board is formed with a plurality of locking blocks, each of the second plugs of the circuit board is formed with a plurality of locking blocks, and each of the protective jackets is secured on the circuit board by the locking blocks of the respective first and second plugs of the circuit board.

5. The suspension lamp in accordance with claim 1, wherein each of the first plugs of the circuit board is juxtaposed to a respective one of the second plugs of the circuit board.

6. The suspension lamp in accordance with claim 1, wherein the positive pole of the power supply wire is connected to a positive pole of the circuit board, and the negative pole of the power supply wire is connected to a negative pole of the circuit board.

7. The suspension lamp in accordance with claim 1, wherein the main body of the wire connection base has a periphery formed with a cutout for passage of the power supply wire.

8. The suspension lamp in accordance with claim 1, wherein each of the protective jackets has an upper end formed with an opening and a periphery formed with a locking slot communicating with the opening, and each of the connecting terminals is inserted into the opening of a respective one of the protective jackets and has a lower end formed with a locking block locked in the locking slot.

9. The suspension lamp in accordance with claim 1, wherein the first plug of each of the electric wires is inserted into a positive pole of the respective connecting terminal, and the second plug of each of the electric wires is inserted into a negative pole of the respective connecting terminal.

10. The suspension lamp in accordance with claim 1, wherein the main body has a center formed with a passage hole for passage of a screw.

11. The suspension lamp in accordance with claim 1, wherein the circuit board has a center formed with a passage hole for passage of a screw.

* * * * *